US009145721B2

(12) United States Patent
Bartels et al.

(10) Patent No.: US 9,145,721 B2
(45) Date of Patent: Sep. 29, 2015

(54) DOOR HINGE

(71) Applicants: Thomas Bartels, Oelde (DE); Andre Bultschnieder, Rheda-Wiedenbrueck (DE); Sergei Gorenbacher, Rheda-Wiedenbrueck (DE)

(72) Inventors: Thomas Bartels, Oelde (DE); Andre Bultschnieder, Rheda-Wiedenbrueck (DE); Sergei Gorenbacher, Rheda-Wiedenbrueck (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 0 days.

(21) Appl. No.: 14/539,232

(22) Filed: Nov. 12, 2014

(65) Prior Publication Data

US 2015/0135480 A1 May 21, 2015

(30) Foreign Application Priority Data

Nov. 15, 2013 (DE) ..... 10 2013 112 645

(51) Int. Cl.
*E05D 7/04* (2006.01)
*E05D 3/02* (2006.01)

(52) U.S. Cl.
CPC *E05D 7/04* (2013.01); *E05D 3/022* (2013.01); *E05D 7/0423* (2013.01); *E05D 2007/0469* (2013.01); *E05D 2007/0476* (2013.01); *E05Y 2900/132* (2013.01)

(58) Field of Classification Search
CPC ..... Y10T 16/5321; Y10T 16/5322; Y10T 16/53225; Y10T 16/53253; Y10T 16/53257; E05D 7/04; E05D 7/0423; E05D 7/0415; E05D 7/043; E05D 2007/0438; E05D 2007/0446; E05D 2007/0453; E05D 2007/0461; E05D 2007/0476; E05D 2007/0484; E05D 2007/0492; E05Y 2900/20
See application file for complete search history.

(56) References Cited

U.S. PATENT DOCUMENTS

| | | | | | |
|---|---|---|---|---|---|
| 3,863,292 | A | * | 2/1975 | Grunert et al. | 16/236 |
| 4,434,523 | A | * | 3/1984 | Grass | 16/242 |
| 5,191,677 | A | * | 3/1993 | Lautenschlager et al. | 16/257 |
| 5,295,282 | A | * | 3/1994 | Lautenschlager | 16/237 |
| 5,339,493 | A | * | 8/1994 | MacIntyre | 16/238 |
| 5,343,595 | A | * | 9/1994 | Lautenschlager | 16/257 |
| 5,361,455 | A | * | 11/1994 | Kiefer | 16/235 |
| 5,694,665 | A | * | 12/1997 | Strickland et al. | 16/238 |
| 5,713,105 | A | * | 2/1998 | Toomey | 16/245 |
| 5,755,011 | A | * | 5/1998 | Green et al. | 16/238 |
| 5,799,370 | A | * | 9/1998 | Davidian et al. | 16/236 |
| 5,806,144 | A | * | 9/1998 | Fries | 16/246 |
| 5,920,958 | A | * | 7/1999 | Domenig et al. | 16/237 |

(Continued)

FOREIGN PATENT DOCUMENTS

| | | | |
|---|---|---|---|
| DE | 102004042924 B | | 12/2005 |
| DE | 102010004772 B3 | * | 1/2011 |

(Continued)

*Primary Examiner* — Chuck Mah
(74) *Attorney, Agent, or Firm* — Andrew Wilford

(57) ABSTRACT

A door hinge has two hinge leaves joined together at a knuckle defining a hinge axis about which the leaves are relatively pivotal. Top and bottom sheet-metal parts forming a housing surround one of the hinge leaves. The top part is formed with a plurality of downwardly projecting side flaps each projecting toward and bearing on an upper face of the bottom part. Each side flap is formed with at least one downward projecting tab that extends past, is bent over, and bears upward against a bottom face of the bottom part. Two rotatable adjustment spindles are each journaled in the housing and threaded in the one leaf so that rotation of the spindles moves the one leaf in a first direction perpendicular to the hinge axis.

12 Claims, 5 Drawing Sheets

(56) References Cited

U.S. PATENT DOCUMENTS

| | | | | |
|---|---|---|---|---|
| 7,334,293 | B2 * | 2/2008 | Erickson et al. | 16/243 |
| 7,552,511 | B2 * | 6/2009 | Campbell et al. | 16/238 |
| 8,516,658 | B2 | 8/2013 | Bultschnieder | |
| 8,549,706 | B2 | 10/2013 | Bultschnieder | |
| 2004/0128794 | A1 * | 7/2004 | Chung | 16/236 |
| 2007/0028420 | A1 * | 2/2007 | Lueffe et al. | 16/382 |
| 2008/0263822 | A1 * | 10/2008 | Sabrowski | 16/236 |
| 2008/0271292 | A1 * | 11/2008 | Lowe et al. | 16/238 |
| 2008/0307606 | A1 * | 12/2008 | Karlsson | 16/243 |
| 2009/0077767 | A1 * | 3/2009 | Alchin | 16/237 |
| 2010/0242227 | A1 * | 9/2010 | Tagtow et al. | 16/237 |
| 2011/0296652 | A1 * | 12/2011 | Zhang | 16/239 |

FOREIGN PATENT DOCUMENTS

| | | | | |
|---|---|---|---|---|
| JP | 09158594 | A | * | 6/1997 |
| JP | 10331508 | A | * | 12/1998 |
| JP | 11172993 | A | * | 6/1999 |

* cited by examiner

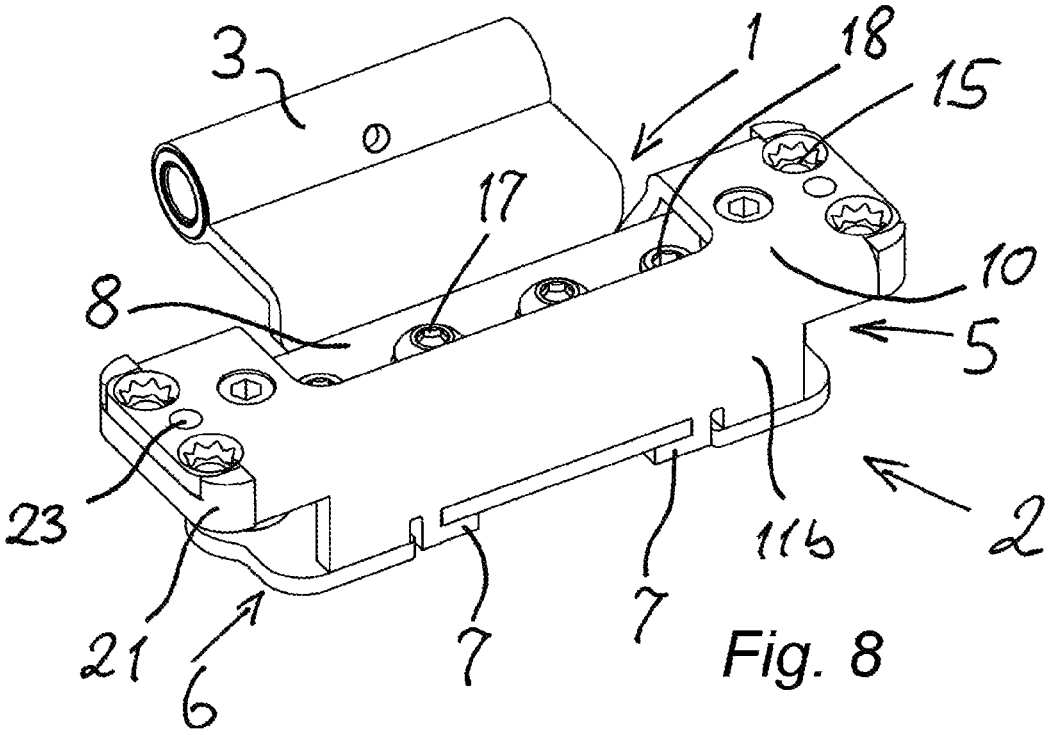
Fig. 8
Fig. 9
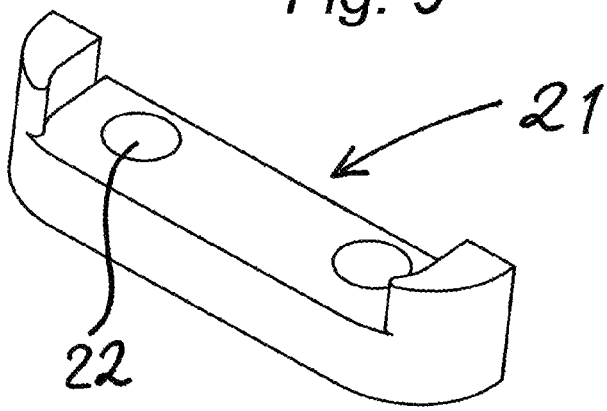

DOOR HINGE

FIELD OF THE INVENTION

The present invention relates to a door hinge. More particularly this invention concerns a door hinge that can be adjusted after mounting between a door frame and an edge of a door panel.

BACKGROUND OF THE INVENTION

A known door hinge has a first and a second hinge leaf that are pivoted together at a knuckle defining a normally vertical pivot axis. The first leaf is adjustably secured in a sheet-metal holder or housing typically recessed in the door frame, although it could be set also in the edge of a door panel. The second hinge is normally secured immovably to the door edge facing the frame, although when the housing is in the door it could be on the face of the door frame. The first leaf is normally supported in the housing on two normally horizontal threaded spindles having axes extending perpendicular to the pivot axis. The spindles are rotatable about their axes in the holder to move the leaf normally horizontally in or out to adjust the gap between the hinged edge of the door and the door frame.

Such a door hinge having the features described above is known from U.S. Pat. Nos. 8,516,658, 8,549,706, and DE 10 2010 011 327. The housing described there comprises, inter alia, two sheet-metal parts that are riveted to one another above and below the adjustment spindle. Sufficient area must be provided on both sheet-metal parts for this riveting. Here, the riveting process represents a relatively laborious process step.

The known door hinge has a relatively complex structure in order to allow the hinge leaf to be adjusted. The two sheet-metal parts are disposed on a separate bottom part. In order to allow an adjustment in the vertical direction, the two sheet-metal parts connected to one another are not connected directly to a door panel or a door frame, but rather via separate fastening elements. These fastening elements are movable in the vertical direction relative to the two sheet-metal parts such that, after the two fastening parts have been fastened, the sheet-metal parts connected to one another may be positioned in the vertical direction with the first hinge leaf accommodated therein. Even if the door hinge described here is distinguished by a compact structure, considerable production expenses result nonetheless, and the plurality of the various parts can also allow a certain degree of play.

In light of this, the object of the invention is to provide a door hinge with the features described above that is particularly easy to produce and is characterized by a high degree of stability.

SUMMARY OF THE INVENTION

A door hinge has according to the invention two hinge leaves joined together at a knuckle defining a hinge axis about which the leaves are relatively pivotal. Top and bottom sheet-metal parts forming a housing surround one of the hinge leaves. The top part is formed with a plurality of laterally projecting side flaps each projecting toward and bearing on an upper face of the bottom part. Each side flap is formed with at least one laterally projecting tab that extends past, is bent over, and bears against a lower face of the bottom part. Two rotatable adjustment spindles are each journaled in the housing and threaded in the one leaf so that rotation of the spindles moves the one leaf in a first direction perpendicular to the hinge axis.

Herein the terms "top," "bottom," "upper," and "lower" are used purely for convenience of description and not as limitations. It is understood that the hinge of this invention could have its parts oriented vertically oppositely, or in virtually any other orientation to the horizontal.

The tabs may be formed in a particularly simple fashion, for example, by die-cutting the upper sheet-metal part. This also provides the advantage that the tabs can be relatively compact and hence space-saving, particularly allowing their formation on the edge of the sheet-metal part to be considered, such that the central areas of the sheet-metal part may be used for the adjustment spindles or any other adjustment mechanisms. Finally, assembly is also particularly simple because it is very easy to bend over the tabs.

According to a preferred refinement to the invention, the top and/or the bottom part are formed with mounting holes for securing the housing to a door panel or on a door frame. In contrast to the known prior art according to U.S. Pat. No. 8,549,706, therefore, the two sheet-metal part parts are connected to one another to form an integral but not unitary assembly should be rigidly fixed to a door panel or a door frame. The two sheet-metal parts are then fixed to the respective door panel or door frame. Accordingly, the two sheet-metal parts preferably also form the housing. The adjustment spindles and any other adjusting mechanisms are then inside the housing formed by the two sheet-metal parts.

In the context of the invention, multiple tabs are provided so that the two sheet-metal parts can correspondingly be connected to one another at multiple points. A particularly reliable and space-saving connection is achieved if the tabs on the flaps of the top part are inserted through slots in the bottom part. Slots of this nature are also able to prevent shifting of the two sheet-metal parts relative to one another at each individual connection point. Another advantage results from the fact that the bottom part is interrupted by the slots only in places where the tabs are located. Neighboring regions of the flaps are therefore able to be supported relative to the bottom part with a planar face adjacent the slots.

The two sheet-metal parts normally have an elongated shape parallel to the rotational axis of the knuckle. The tabs and the optional slots are then preferably located on the longitudinal sides of the sheet-metal parts. In particular, the slots on the longitudinal sides may extend transversely, with the tabs inserted through the slots being reversed in the longitudinal direction. The positive connection provided by the tabs is then concentrated only on an edge region.

According to a particularly preferred embodiment of the invention, one wing is disposed on each opposite longitudinal side of the bottom part by a step relative to the middle section of the bottom part offset in the direction of the top part. Such an embodiment allows the tabs bent over toward the wings on an outer side formed by the bottom part to be flush or approximately flush with the middle section. The two wings, which are each preferably engaged from behind by two tabs, are then cut back to be offset towards the rear originating from the middle section so that the reversed tabs do not project.

According to the invention, the two sheet-metal parts are connected to one another in a positive fashion by the tabs, with the two sheet-metal parts being able to form a box-like housing for accommodating the one hinge leaf. Because the positive connection is achieved by the reversal of the tabs, depending on the performance of the method, a certain degree of play or some clearance between the two sheet-metal parts cannot always be eliminated with certainty.

In order to reduce or prevent such play, the top part and the bottom part may also be connected by at least one screw in addition to the positive connection by means of the angular-offset tabs. When the screw is tightened, the two sheet-metal parts are additionally connected and pulled one toward the other, allowing play to be eliminated. In order to keep production costs low, the screw may also be used in combination with a blind-rivet nut, so that it is not necessary to cut a thread in the sheet-metal parts. It is also possible for a blind-rivet nut to be used that is open at both ends in order to attach the screw on one side and another element, for example, a cover plate, on the other side.

As explained above, the mounting holes for arranging the housing on a door frame or a door panel may be formed on the top part as well as on the bottom part. Here, the actual method of fastening is selected dependent upon the installation situation. If, for example, only a very small amount of installation space is available, in particular when installing the housing on a thin door, the mounting holes may be placed in the sheet-metal part that is located to the outside in the mounted state. Correspondingly, in this case, less material must be milled away below the housing, so that material remains a mounting screw.

According to a preferred embodiment of the invention, the housing is mounted in such a way that, in its installed state, the top part is located on the outside of the door panel or door frame. When only a small amount of material is available, it is advisable for the mounting holes to be formed on opposite end sections of the top part, with the bottom part having a smaller design in this case, which necessitates the removal of only a small amount of material from the door frame or the door panel for the arrangement of the housing. However, such a design must take into account the fact that the top part comprises lateral flaps that extend in the direction of the bottom part. If a projection is present even in the region of the mounting holes, the sharp edges of the top part could dig into the material of the door frame or door panel below it, which could cause the material to become damaged. Therefore, it is within the scope of the invention to provide spacer blocks made of plastic on the end sections of the top part provided with mounting holes. It is useful for the end sections to then each be backed with a spacer block made of plastic in the direction of the bottom part. Preferably, the spacer block has a shape that is complementary to that of the top part, such that it may be complementarily fitted thereto and, in particular, be clicked in during assembly. It is useful for the spacer block to have a flat, smooth contact surface in the direction of the bottom part. If the spacer block is also disposed behind the mounting holes and comprises pass-through holes, the advantage ultimately results that mounting screws are inserted not only through the mounting holes but also through the pass-through holes of the spacer blocks, thus reducing the risk of a crooked, unsuitable screw attachment. Because plastic is comparably soft, the spacer block can also be used for mounting a cover plate by self-tapping screws, with openings then being provided at appropriate points on the top part.

In principle, it is possible for the adjustment spindles to be inserted with their threads directly in threaded bores of the first hinge leaf, with the first hinge leaf then being directly adjustable in the first direction along the longitudinal axis of the adjustment spindles by rotating the adjustment spindles.

According to an alternative embodiment based on a generic hinge subjected to a separate inventive step, the adjustment spindles to each engage by a thread in a threaded bore of a bottom part that may be positioned by rotating the adjustment spindles between the top part and the bottom part, for the first hinge leaf to be adjustable on the bottom part in a direction running perpendicular to the longitudinal axis of the adjustment spindles and in a second direction along a positive-fitting guide, and for the first hinge leaf to engage the longitudinal edges of the bottom part through a double offset. The second direction normally extends along a connection line between the adjustment spindles, i.e. in the vertical direction when the door hinge is mounted. Using the measures described above, it is possible to achieve a particularly simple and reliable adjustment of the first hinge leaf in the vertical direction. In contrast to the embodiment known from U.S. Pat. No. 8,549,706, the adjustment in the vertical direction occurs inside the cavity formed by the two sheet-metal parts. Correspondingly, the two sheet-metal parts themselves can then be fixed to a door panel or a door frame if adjustment in two directions is required.

The double offset allows the entire height of the first hinge leaf to be used for the positive-fitting guide, resulting in a very even and reliable distribution of force. The positive-fitting guide is attained here only by the shape of the first hinge leaf and the bottom part. No additional elements are necessary to guide the parts toward one another. In contrast to the formation of guide grooves or the like, the offset of the first hinge leaf that is normally also made of sheet metal, is particularly simple to achieve.

The adjustment spindles may comprise a continuous thread between the sheet-metal parts. Preferably, however, the thread extends only over part of the intervening space and is delimited by thickened areas (for example cylindrical sections having the outer diameter of the thread). Thus, the adjustment path may be limited such that the housing cannot be spread apart or even broken by an adjustment.

In order to be able to fix the first hinge leaf at a desired height, according to a preferred embodiment of the invention, at least one binding screw is provided that extends through a longitudinal hole of the bottom part and that engages with its thread in a threaded bore of the first hinge leaf. In order to provide improved protection against tipping and to achieve an even binding lock, it is particularly preferred that at least two binding screws be provided that are disposed at a distance from one another.

In order to prevent the binding screws from accidentally being completely screwed out when loosened, the binding screws advantageously comprise a deformation at the end of the thread as an anti-removal feature. For example, a compression, a cross-shaped impression, or the like may be provided on the free end. The binding screw is then dimensioned in such a way that its free end is spread and projects past the threaded bore of the first hinge leaf. If the binding screw is screwed out far enough that the deformation reaches the end of the threaded bore, any further rotation is blocked.

In principle, it is possible for positioning along the second, i.e. perpendicular to the vertical, direction to occur in that the binding screws are loosened and the height of the door panel is adjusted before the binding screws are tightened again after the height adjustment of the door panel. In the context of such an embodiment, the height adjustment of the door panel may occur, for example, by underlying wedges.

In order to simplify the height adjustment by a user, according to a preferred embodiment of the invention, an adjuster is provided on the bottom part and the first hinge leaf in order to position the first hinge leaf in the second direction. In particular, the adjuster may comprise at least one adjusting screw placed in the bottom part that acts on a wedge surface of the first hinge leaf or on a wedge resting against the first hinge leaf. The wedge is displaced as a function of the adjustment of the adjusting screw. If the adjusting screw is screwed in, the wedge is correspondingly pushed away from the adjusting screw.

In principle, it is sufficient for the door hinge to comprise only one adjusting screw with an associated wedge surface or an associated wedge. In such a case, the adjusting screw and the wedge should be disposed in such a way that the wedge surface or the wedge is pressed against the adjusting screw by weight such that, when the adjusting screw is screwed in, the first hinge leaf is lifted.

In order to allow the hinge to be used as desired for doors closing to the left or to the right, it is preferable for a wedge surface or a wedge to be provided along the second direction on both sides of the hinge leaf.

BRIEF DESCRIPTION OF THE DRAWING

The above and other objects, features, and advantages will become more readily apparent from the following description, reference being made to the accompanying drawing in which:

FIG. 8 is a view like FIG. 1 of another embodiment of the door hinge,

FIG. 9 is a perspective view of the spacer used in the FIG. 8 embodiment.

SPECIFIC DESCRIPTION OF THE INVENTION

Figure 1:
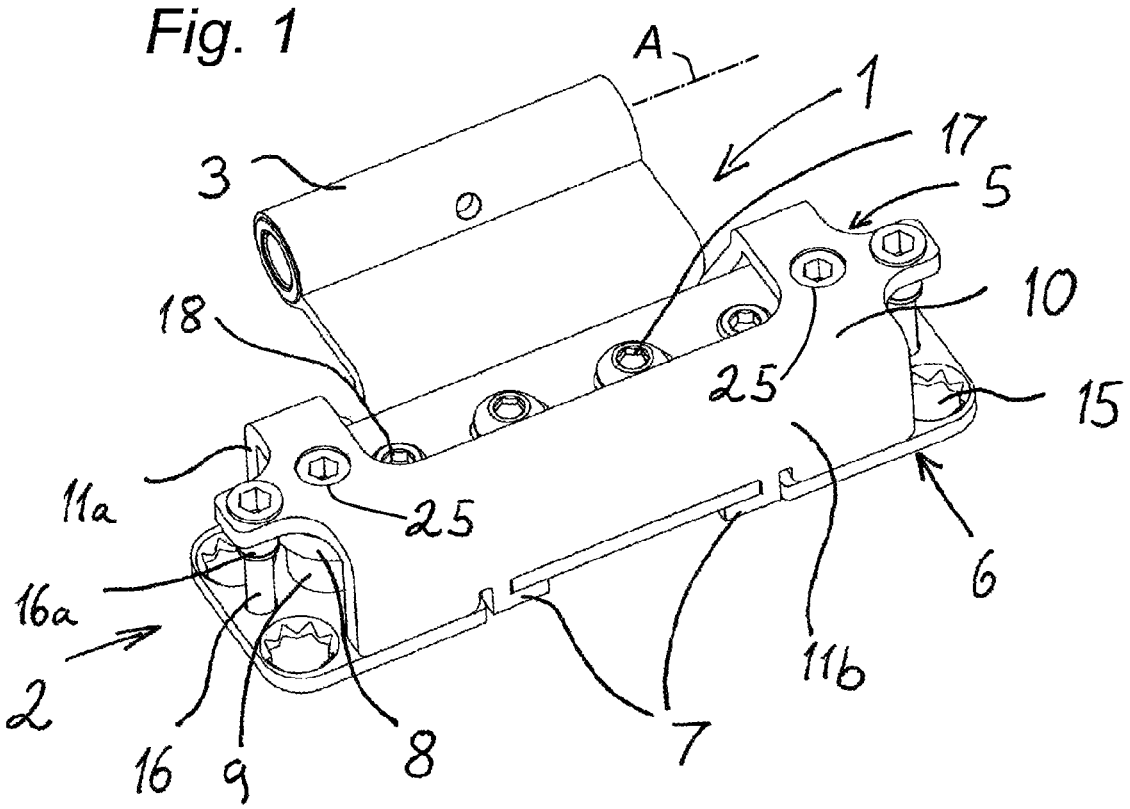
FIG. 1 is a perspective top view of the assembled door hinge with the first hinge leaf and a housing for the first hinge leaf.
Figure 3A:
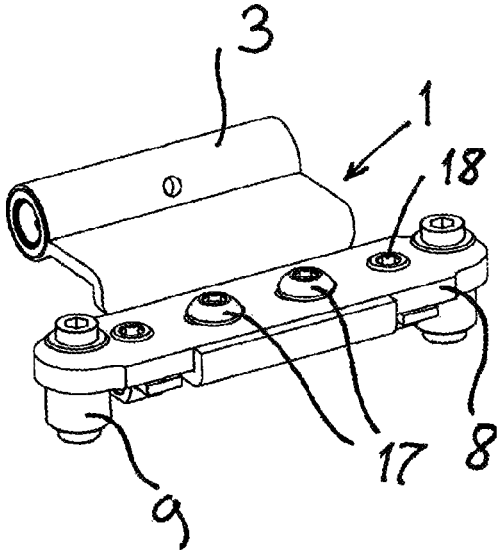
FIGS. 3A, 3B, and 3*c* are perspective views from above of the three principal parts of the FIG. 1 hinge.
Figure 3B:
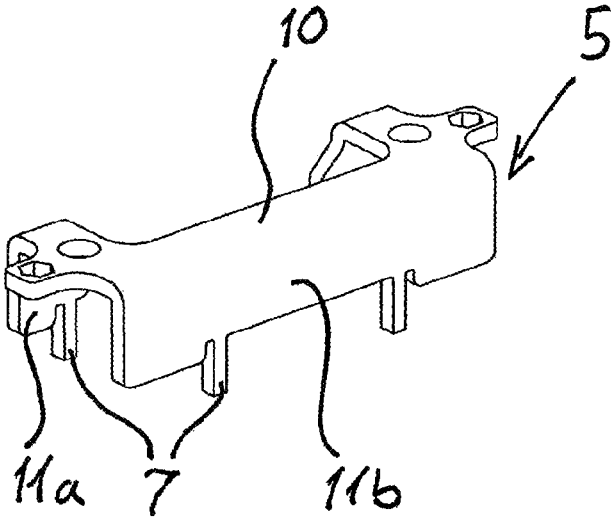
Figure 3C:
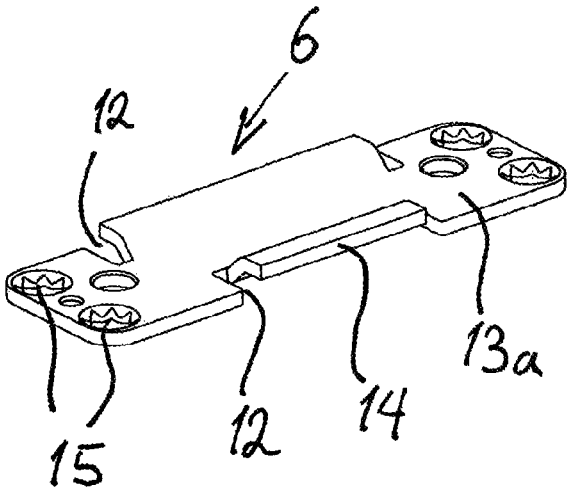
Figure 6:
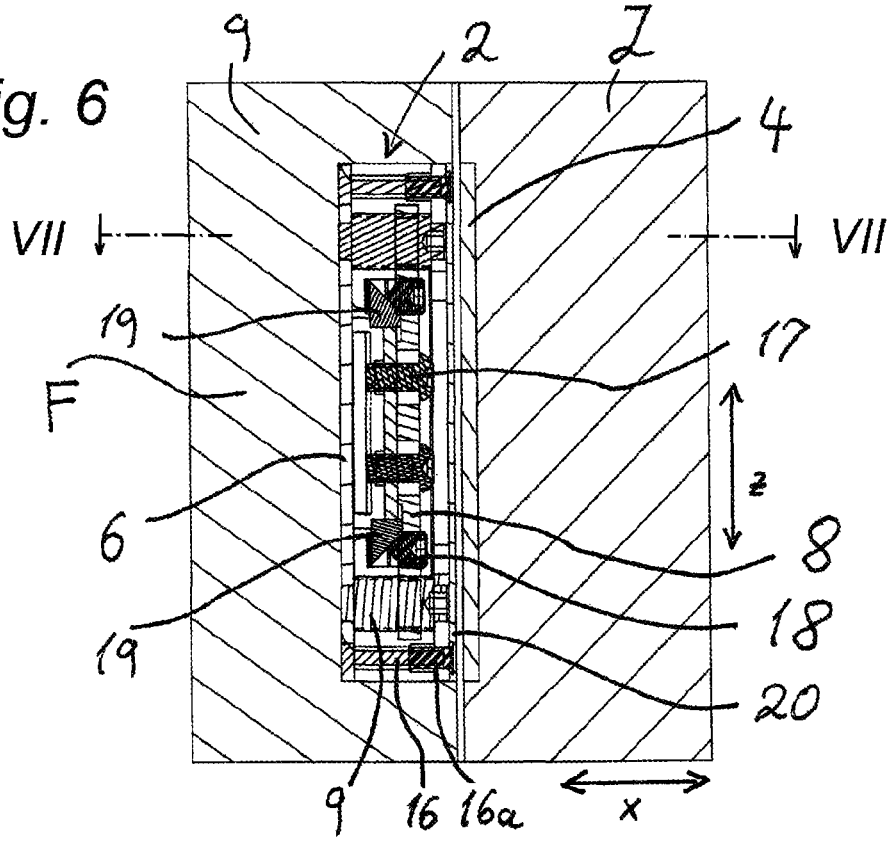
FIG. 6 is a vertical section of the hinge of the installed hinge of this invention in a view with the door closed.
Figure 7:
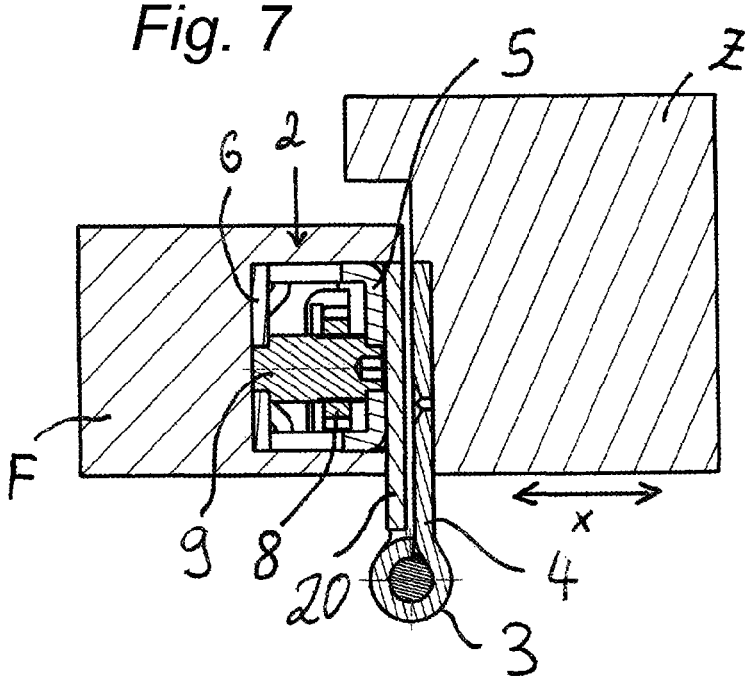
FIG. 7 is a horizontal section taken along line VII-VII of FIG. 6.

As seen in FIG. 1 a first hinge leaf 1 is adjustably secured in a housing 2 and is rotatable about an axis A at a hinge knuckle 3 to a second hinge leaf 4 shown in FIGS. 6 and 7. FIGS. 1 and 3 show a housing 2 formed of two sheet-metal parts 5 and 6. The part 5 is of one piece and generally U-shaped and the part 6 is flat and has planar faces 13*a* and 13*b*. FIGS. 3B and 3C show the two sheet-metal parts 5 and 6 separately, before assembly. When the two sheet-metal parts 5 and 6 are fitted together, tabs 7 unitarily formed on the top part 5 are bent over so that the two sheet-metal parts 5 and 6 are attached to one another in a positive-fit such that they cannot be separated without damage to the parts 5 and 6.

Figure 2:
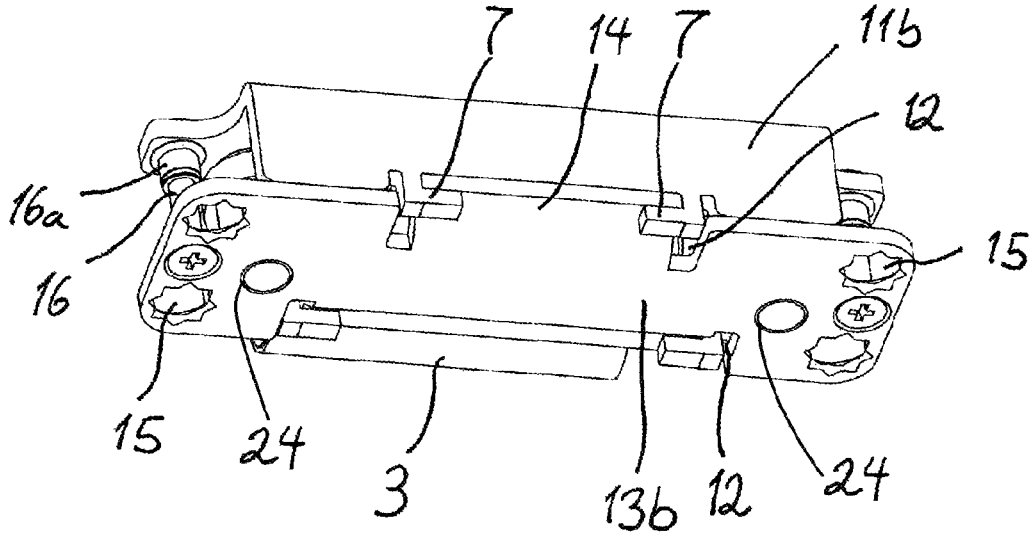
FIG. 2 is a perspective view from below of the hinge of FIG. 1.

Before the two sheet-metal parts 5 and 6 are attached to one another during assembly, resulting in a permanent connection, the first hinge leaf 1 is inserted between the two sheet-metal parts 5 and 6 along with a rigid cast-metal base plate 8. Here, the base plate 8 is formed with bores threadedly receiving respective adjustment spindles 9 whose reduced-diameter ends engage in respective journal holes 24 and 25 of the parts 5 and 6 (see FIG. 1 and FIG. 2).

Here, the top part 5 comprises an essentially planar main section 10 formed with the journal holes 25 for the adjustment spindles 9. Planar flaps 11*a* and 11*b* extend parallel to each other and perpendicular to the section 10 from opposite longitudinal edges of the section 10. The flap 11*a* is formed of two coplanar sections that axially flank the leaf 1, and the flap 11*b* is a single piece laterally closing that side of the housing. The bottom part 6, which is essentially a planar plate, is received between the flaps 11*a* and 11*b*. The corners of the flaps 11*a* and 11*b* are each formed with one of the unitary downwardly extending tabs 7, and each longitudinal edge of the bottom part 6 is formed with a respective cutout 12 through which the respective tab 7 projects, and between these cutouts 12 each of the flaps 11*a* and 11*b* is cut back by a distance equal to the thickness of the tabs 7.

When the first hinge leaf 1 with the base plate 8 are inserted into the housing 2, the two flaps 11*a* each formed with a pair of the tabs 7 (see FIG. 3) are located above and below the first hinge leaf 1 when the rotational axis A of the knuckle 3 is vertical.

For assembly, the tabs 7 are bent back in order to connect the two sheet-metal parts 5 and 6 to one another integrally and permanently. In addition the part 6 is formed along each longitudinal edge with an integral wing 14 that is bent up above the lower face 13*b* of the part 6 by a distance equal to a thickness t of the tabs 7, which is typically equal to the thickness of the sheet metal forming the part 5. Thus the housing 2 is assembled by fitting the two parts 5 and 6 together so the two pairs of tabs 7 project downward through the respective cutouts 12 past the lower face 13*b* of the part 6 and the lower edges of the flaps 11*a* and 11*b* sit are coplanar or flush with this lower face 13, then the tabs 7 of each pair are bent over to extend toward each other and lie against the wing parts 14, and above the lower face 13 of the part 6. Thus nothing on the assembled hinge projects past this planar lower face 13, making routing of a pocket for the hinge easy.

Furthermore the positive connection by the tabs 7 allows for a mounting that is particularly simple but at the same time reliable. A very small amount of space is required for the connection. It may be particularly seen from FIG. 1 and FIG. 2 that the bottom part 6 may be used over its entire length for the arrangement of screws, bores, or the like.

The bottom part 6 is formed with mounting holes 15 by means of which the housing 2 may be secured by screws to a door frame Z or, particularly preferably, to the edge of door panel F. In this context, FIGS. 6 and 7 show that the two sheet-metal parts 5 and 6 connected to one another in a positive fashion are thus arranged in a fixed and unmovable fashion on the door frame Z or the door panel F, with the two sheet-metal parts 5 and 6 forming the rigid closed housing 2 containing the base plate 8 fixed to the leaf 1.

In addition to the permanent, positive connection by means of the tabs 7, the top part 5 and the bottom part 6 may also be connected to each other by at least one screw 16. According to FIG. 2, the screw 16 is provided directly next to each adjustment spindle 9, with its head bearing upward on the part 6 and its shank threaded into a blind rivet 16*a* set in the part 5. Any play that may still be present between the two sheet-metal parts 5 and 6 in spite of the permanent, positive connection by the tabs 7 may be eliminated with certainty by the screws 16. Moreover, the screws 16 also stabilize the assembly at the adjustment spindles 9. Due to the use of the blind-rivet nuts 16*a*, it is not necessary to cut a thread in the sheet-metal parts 5 and 6, although it is also possible to do so as an alternative.

Using the adjustment spindles 9, the hinge leaf 1 may be adjusted via the base plate 8 along a longitudinal axis of the adjustment spindles 9 in a first direction x typically horizontally parallel to the plane of the door F. Thus as shown in FIG. 7, when the entire door hinge is mounted between a door panel F and a door frame Z, rotation of the adjustment spindles 9 by an allen wrench or screwdriver in the end exposed through the hole 25 on the part 5 moves the first hinge leaf 1 via the base plate 8 in the horizontal direction x, thus changing the lateral spacing between the door panel F and the door frame Z. Such an adjustment is also referred to in practice as side-to-side adjustment.

The structure of the door hinge with the first hinge leaf 1 and the base plate 8 also allows an adjustment perpendicular to the longitudinal axis of the adjustment spindle 9 along a second direction z perpendicular to the plane of the door F, which is parallel to the view plane in FIG. 6 and perpendicular thereto in FIG. 7. This second direction z extends vertically and allows the vertical position of the door F in the frame Z to be adjusted.

Figure 4:
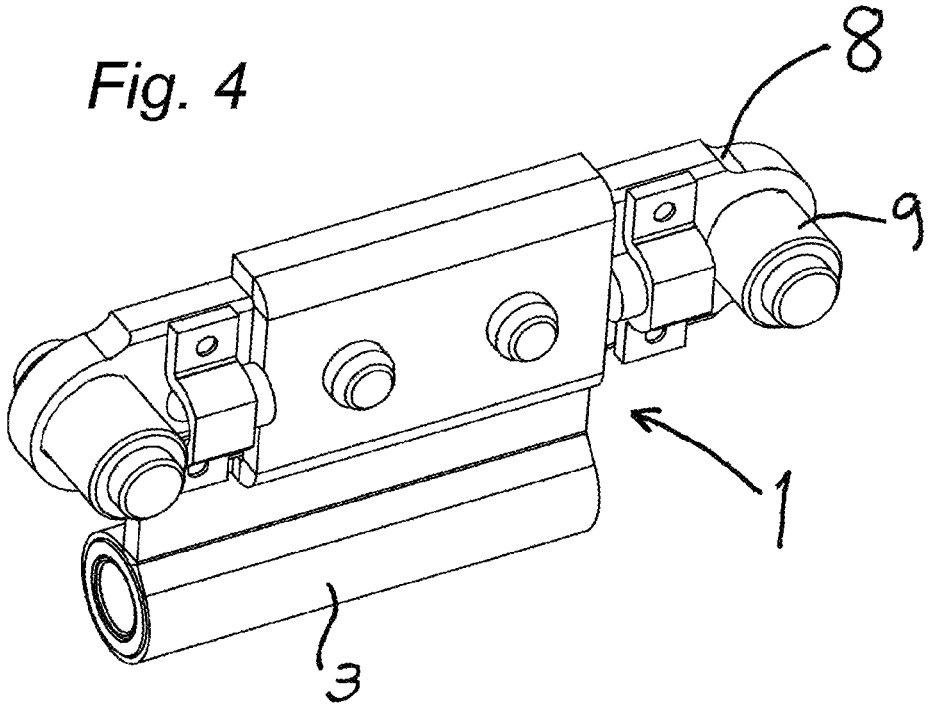
FIG. 4 is a large-scale bottom view of the bottom part shown in FIG. 3A.

According to FIG. 3, two screws 17 are provided that each extending through a longitudinal slot in the base plate 8 and engage in a threaded bore of the first hinge leaf 1. FIG. 4 shows that the ends of the binding screws 17 project through the threaded bores in the hinge leaf 1. These projecting ends are upset or deformed such that the binding screws 17 cannot be inadvertently screwed out of the first hinge leaf 1.

Figure 5:
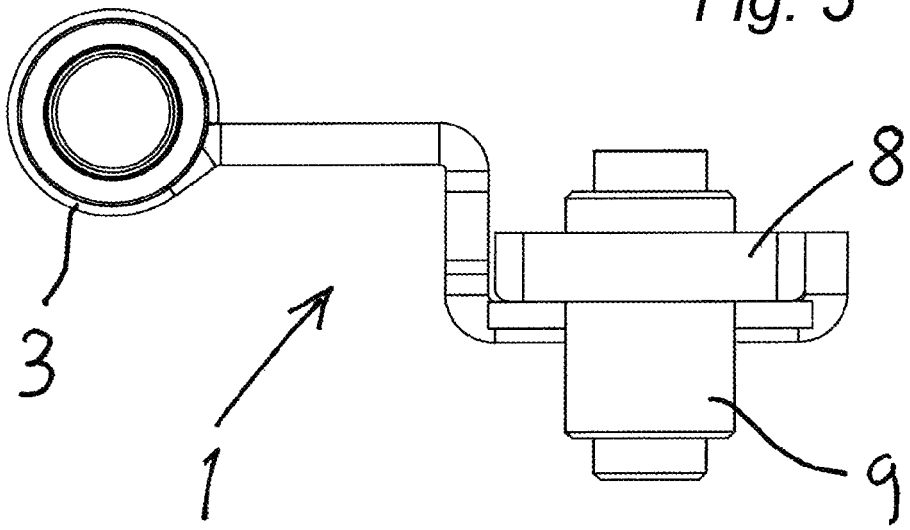
FIG. 5 is a large-scale axial end view of the bottom part.

When the binding screws 17 are loosened, the first hinge leaf 1 is movable only in direction z on the base plate 8. This is because the first hinge leaf according to FIG. 5 is formed generally Z-shaped, with a double offset, and the first hinge leaf 1 slides at the offset on a longitudinal edge of the base plate 8.

Finally, adjusting screws 18 that are part of an adjuster for shifting the first hinge leaf 1 along the second direction z are shown in FIG. 3 as well. According to FIG. 6, the adjusting screws 18 act on respective wedges 19 that bear axially oppositely against the first hinge leaf 1. In order to lift the first hinge leaf 1, the lower adjusting screw 18 is screwed into the base plate 8 so that the respective wedge 19 is lifted. At the same time, the upper adjusting screw 18 shown in FIG. 6 may be loosened so that the respective wedge 19 does not block upward movement of the first hinge leaf 1. In order to adjust the first hinge leaf 1 in the vertical direction, only a single lower wedge 19 with an adjusting screw 18. However, in order to be able to use the hinge for doors that open to the left as well as doors that open to the right, it is advantageous for wedges 19 and respective adjusting screws 18 to be provided above and below the first hinge leaf 1.

FIG. 7 shows that the housing 2 is provided with a cover plate 20 on the free side of the door panel F. This cover plate 20 is fastened via short screws to the blind-rivet nuts 16*a*, to which end the thread of the blind-rivet nuts 16*a* is accessible from both ends.

FIG. 8 shows an alternative embodiment in which the mounting holes 15 are not formed on the bottom part but rather on opposite ends of the top part 5. These ends form the upper and lower ends of the housing 2 in the mounted state. The bottom part 6 disposed underneath the part 5 is vertically shorter in the vertical direction z, so that less material overall must be cut away from the door panel F. Thus the variant shown in FIG. 8 may be considered for installation on a thinner door or one of less stable material.

However, it should be noted that the top part 5 laterally comprises the flaps 11*a* and 11*b* that, during installation of the housing 2, are not supposed to dig into the material located therebelow in an uncontrolled fashion. In order to allow a particularly even and reliable contact by the housing 2 when attached to a door panel F, a spacer block 21 made of plastic is placed on each end section of the top part 5 below the mounting holes 15. The bottom of the spacer block 21 is designed as a flat contact surface.

FIG. 9 shows a detailed view of the spacer block 21. The spacer block 21 is formed with throughgoing holes 22 for the mounting screws that will pass through the holes 15. This also results in the advantage that the mounting screws are guided through the holes 22 over a greater length, thus reducing the risk of defective installation.

In the embodiment according to FIG. 8, another difference is that the two sheet-metal parts 5 and 6 are connected to one another only by the tabs 7 and not also by the screws 16.

In order to be able to subsequently install a cover plate 20 on the housing 2, holes 23 are formed in the section 10 of the top part 5 between the mounting holes 15. These holes 23 align with the holes 22 of the spacer block 21. The cover plate 20 may therefore be installed using simple self-tapping screws that extend through the openings 23 and cut into the plastic material of the spacer block 21.

The adjustment spindles 9 are only shown schematically in the drawing. However, it is advantageous for the thread of the adjustment spindles 9 to only extend over a central large-diameter portion between the two sheet-metal parts 5 and 6. In particular, the length and position of the threaded region may be adjusted in such a way that the base plate 8 as well as the hinge leaf 1 attached thereto cannot strike against the top part 5 or against the bottom part 6, which could cause the housing 2 to be spread apart or even break. At the end of the thread of the adjustment spindle 9, an increase in diameter is provided that prevents any further rotation. For example, the adjustment spindles 9 may have between the parts 5 and 6 a cylindrical shape that has essentially the outer diameter of the thread. The adjustment spindles 9 may also subsequently be deformed after insertion in the base plate 8. Naturally, providing a thickened region at only one end of the thread of the adjustment spindles 9 also lies within the scope of the invention.

We claim:

1. A door hinge comprising:

two hinge leaves joined together at a respective knuckles defining a hinge axis about which the leaves are relatively pivotal;

top and bottom sheet-metal parts forming a housing surrounding one of the hinge leaves, the top part being formed with a plurality of laterally projecting side flaps each projecting toward and bearing on an upper face of the bottom part, each side flap being formed with at least one tab that projects laterally of the respective flap, extends past a lower face of the bottom part, and is bent over and bears against the lower face of the bottom part; and two rotatable adjustment spindles each journaled in the housing and operatively threadedly connected to the one leaf, whereby rotation of the spindles moves the one leaf in a first direction perpendicular to the hinge axis.

2. The door hinge defined in claim 1, wherein one of the parts is formed with holes each adapted to receive a mounting screw.

3. The door hinge defined in claim 2, wherein the holes are formed in the bottom part and the hinge further comprises:

solid plastic spacer blocks sandwiched between the parts and formed with passages aligned with the holes, whereby the mounting screws pass through the spacer blocks.

4. The door hinge defined in claim 1, wherein the bottom part is formed with a pair of bent-up wings bearing upward on the flaps, the tabs bearing upward on the wings.

5. The door hinge defined in claim 4 wherein the tabs are bent up so as to lie in a common plane with the lower face of the bottom part between the wings.

6. The door hinge defined in claim 1, further comprising:

at least one screw bearing axially on one of the parts and seated in the other of the parts and tightenable to lock the parts together.

7. The door hinge defined in claim 1, wherein the spindles are rotatable about respective axes extending in a first direction perpendicular to the hinge axis, the hinge further comprising:

a base plate between the parts and formed with respective threaded hole receiving the spindles, the base plate being secured to the one leaf for movement of the one leaf in a second direction perpendicular to the first direction relative to the base plate.

8. The door hinge defined in claim 7, wherein the one leaf is formed with a center offset bearing in the first direction on the base plate.

9. The door hinge defined in claim 7, the base plate being formed with two threaded bores, the one leaf being formed with at least two slots throughgoing in the first direction, aligned in the first direction with the threaded bores, and elongated in the second direction, the hinge further comprising:

respective screws engaged through the slots with the threaded bores of the base plate, whereby when the screws are tightened the base plate is locked to the one leaf and when the screws are loosened the leaf can move in the second direction relative to the base plate.

10. The door hinge defined in claim 9, wherein each of the screws has a spread end projecting through the one leaf and preventing withdrawal of the respective screw from the respective threaded bore.

11. The door hinge defined in claim 1, the hinge further comprising:

a mechanism engaged between the parts and the one leaf for vertically shifting same relative to the parts in a second direction perpendicular to the first direction.

12. The door hinge defined in claim 11, wherein the mechanism includes at least one wedge engaging in the second direction an end edge of the base plate and means for shifting the wedge in the first direction and thereby displacing the base plate and the one leaf in the second direction.

* * * * *